US005241883A

United States Patent [19]

Coppier

[11] Patent Number: 5,241,883

[45] Date of Patent: Sep. 7, 1993

[54] METHOD OF MANUFACTURING A KNIFE BLADE

[75] Inventor: Michel Coppier, Etercy, France

[73] Assignee: SEB S.A., Selongey, France

[21] Appl. No.: 997,937

[22] Filed: Dec. 29, 1992

[30] Foreign Application Priority Data

Jan. 8, 1992 [FR] France ..... 92 00128

[51] Int. Cl.[5] ..... B21K 11/02

[52] U.S. Cl. ..... 76/104.1; 30/346

[58] Field of Search ..... 76/104.1, 101.1; 30/346, 351

[56] References Cited

U.S. PATENT DOCUMENTS 3,035,344 5/1962 Brown ..... 30/346

*Primary Examiner*—Roscoe V. Parker

*Attorney, Agent, or Firm*—Young & Thompson

[57] ABSTRACT

The method of manufacturing the knife blade (1), comprises the following steps: by stamping the two faces (1*a*, 1*b*) of a blade blank (1), a series of protuberances (2, 3) are formed, extending transversely to the length of the blade and, during the same stamping operation, a chamfer is formed on one of the longitudinal edges of the blade, after which, said edge (5) of the blade opposite the chamfer is sharpened. Use especially in order to avoid the blade sticking when cutting food.

8 Claims, 2 Drawing Sheets

METHOD OF MANUFACTURING A KNIFE BLADE

FIELD OF THE INVENTION

The present invention relates to a method of manufacturing a knife blade by stamping a steel blade blank.

SUMMARY OF THE INVENTION

The aim of the present invention is to create a knife blade making it possible to limit the cutting forces by reducing the sticking of the food to the lateral faces of the knife blade.

According to the invention, this method is characterized by the following steps:

by stamping the two faces of a blade blank, a series of protuberances are formed, extending transversely to the length of the blade and, during the same stamping operation, parallel to one of the longitudinal edges of the blade, on both faces of the latter, two protruding ridges are formed, arranged in the extension of the vertex of the protuberances and a chamfer is formed, at least between one of these edges and the longitudinal edge of the blade, after which, said edge of the blade is sharpened.

The protuberances formed on the opposite faces of the blade make it possible to reduce friction with the food, when cutting, and consequently to limit the forces required from the user. In particular, these protuberances make it possible to limit sticking between the food, especially fatty food, and the lateral faces of the blade.

Moreover, the stamping creates a chamfer on one of the longitudinal edges of the blade which simplifies sharpening, since it is sufficient to sharpen the blade opposite the chamfer.

Other features and advantages of the invention will further appear in the description below.

BRIEF DESCRIPTION OF THE DRAWINGS

In the attached drawings, given by way of non-limiting examples.

DESCRIPTION OF THE PREFERRED EMBODIMENT

Figure 1:
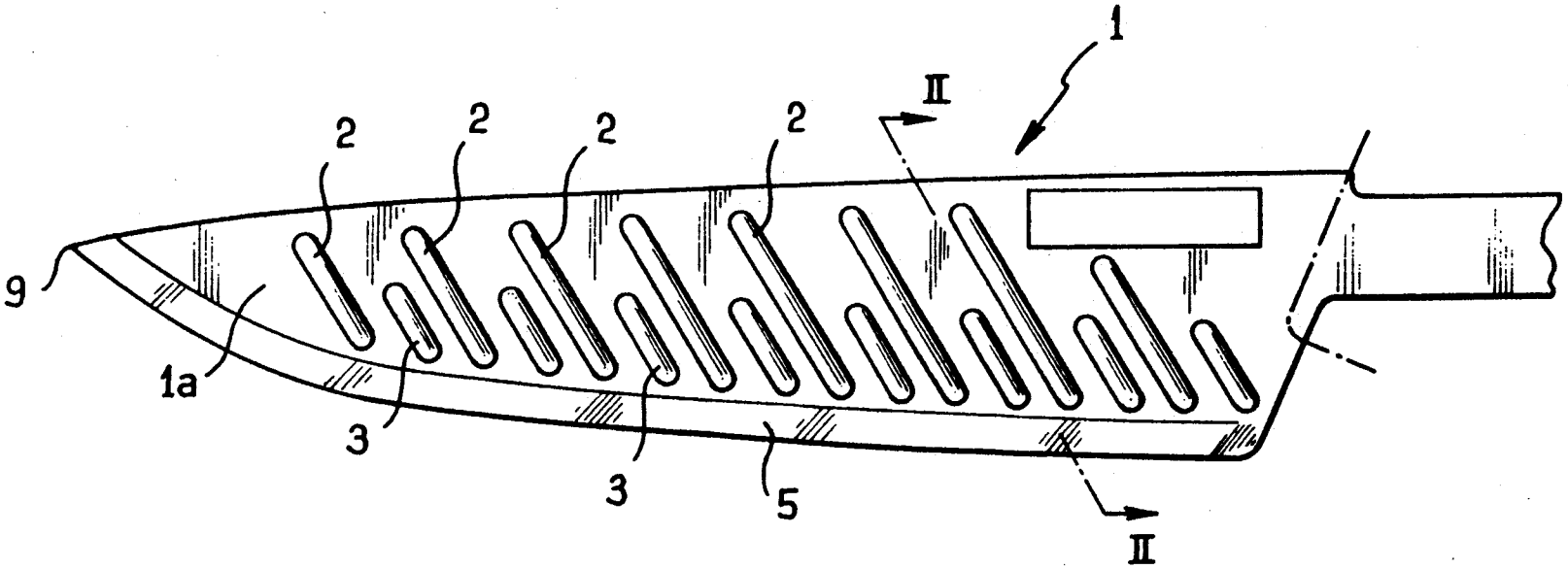
FIG. 1 is a plan view of one of the faces of a knife blade obtained according to the method in accordance with the invention.
Figure 2:
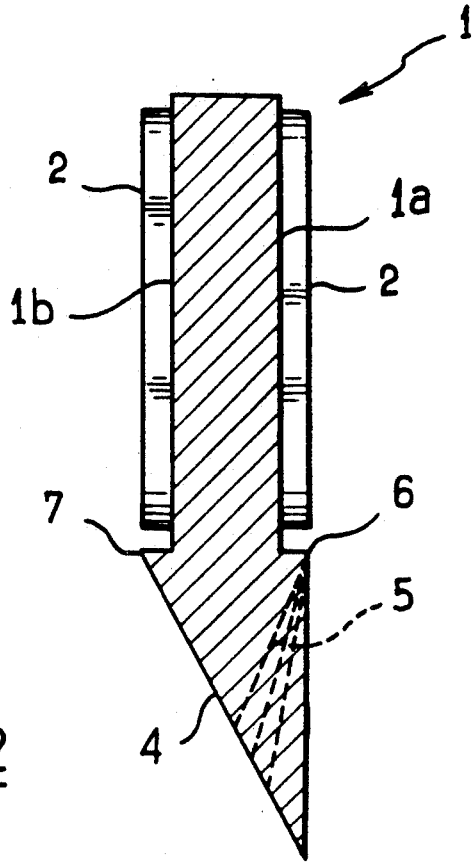
FIG. 2 is a sectional view along the plane II—II of FIG. 1.
Figure 3:
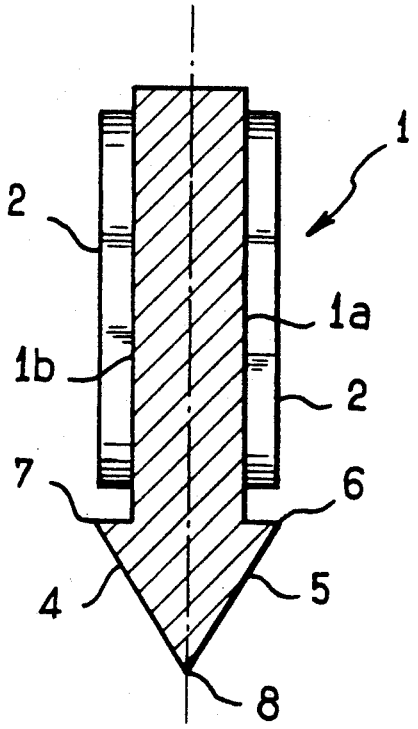
FIG. 3 is a view similar to FIG. 2, after sharpening the edge of the blade opposite the chamfer.

The method of manufacturing the knife blade 1 represented in FIG. 1, comprises the following steps:

by stamping the two faces 1*a*, 1*b* (see FIG. 2) of a blade blank 1, a series of protuberances 2, 3 are formed, extending transversely to the length of the blade 1 and, during the same stamping operation, parallel to one of the longitudinal edges of the blade, on both faces of the latter, two protruding ridges 6, 7 are formed, arranged in the extension of the vertex of the protuberances 2, 3 and a chamfer 4 is formed, at least between one of these ridges 6, 7 and the longitudinal edge of the blade, after which, said edge of the blade is sharpened (see FIG. 3). The sharpened part is designated by the reference 5.

In FIG. 2 it is seen that after the stamping operation, the thickest part of the longitudinal edge of the blade 1 adjacent to the chamfer 4 is delimited by two ridges 6, 7 which are situated on the two opposite faces of the blade and arranged in the extension of the vertices of the protuberances 2 formed on these two faces.

Moreover, the sharpening burr formed on the cutting edge 8 (see FIG. 3) of the blade 1 is removed by chemical polishing.

The sharpening carried out on the edge opposite the chamfer 4 creates a chamfer 5 which is symmetric or non-symmetric with the stamped chamfer 4.

In the example represented in FIG. 1, the protuberances 2, 3 are constituted by elongated, parallel raised sections whose ends and vertices are rounded.

Moreover, the elongated raised sections 2, 3 extend in a direction forming a certain angle with the length of the blade, which is such that the ends of the elongated raised sections 2, 3 adjacent to the cutting edge 5 of the blade are further from the pointed end 9 of the blade 1 than the other ends.

The protuberances or raised sections 2, 3 and the chamfer 4 are preferably formed by cold forging, under a pressure of several tens of tons, between two matrices whose surface reproduces the hollowed-out relief to be formed on the faces of the steel blank of the blade.

By way of non-limiting example, the width of the protuberances 2, 3 lies between a few tens of millimeters and a few millimeters. The spacing between the protuberances 2, 3 is of the same order of magnitude.

Some protuberances 3 are shorter than the others 2, as indicated in FIG. 1, in which the short protuberances 3 lie between long protuberances 2.

The main advantages of the method which has just been described are as follows: the whole of the blade is produced in a single stamping operation and a single sharpening operation.

The knife thus produced limits, by virtue of the protuberances 2, 3, the sticking effects regarding food, especially fatty food, and thus reduces the forces required from the users.

Needless to say, the invention is not limited to the embodiment which has just been described and numerous modifications may be applied to the latter without departing from the scope of the invention.

Hence, according to a variant, during stamping of the blank, two symmetric or non-symmetric chamfers (see dotted lines in FIG. 2) are created between the two ridges 6, 7 and the longitudinal edge of the blade.

I claim:

1. A method of manufacturing a knife blade, comprising the following steps:

by stamping the two faces (1*a*, 1*b*) of a blade blank (1), a series of protuberances (2, 3) are formed, extending transversely to the length of the blade and, during the same stamping operation, parallel to one of the longitudinal edges of the blade, on both faces of the latter, two protruding ridges (6, 7) are formed, arranged in the extension of the vertex of the protuberances (2, 3) and a chamfer (4) is formed, at least between one of these ridges (6, 7) and the longitudinal edge of the blade, after which, said edge of the blade is sharpened.

2. The method as claimed in claim 1, wherein the sharpening burr formed on the cutting edge (8) of the blade is removed by chemical polishing.

3. The method as claimed in claim 1, wherein the sharpening which is carried out on the edge opposite the chamfer (4) creates a chamfer (5) which is symmetric or non-symmetric with the stamped chamfer (4).

4. The method as claimed in claim 1 wherein the protuberances (2, 3) are constituted by elongated, parallel raised sections whose ends and vertices are rounded.

5. The method as claimed in claim 4, wherein the elongated raised sections (2, 3) extend in a direction forming a certain angle with the length of the blade.

6. The method as claimed in claim 5, wherein the ends of the elongated raised sections (2, 3) adjacent to the cutting edge (5) of the blade are further from the pointed end (9) of the blade than the other ends.

7. The method as claimed in claim 1, wherein said protuberances (2, 3) or raised sections and said chamfer are formed by cold forging.

8. The method as claimed in claim 1, wherein, during stamping of the blank, two symmetric or non-symmetric chamfers are created between the two ridges (6, 7) and the longitudinal edge of the blade.

* * * * *